United States Patent [19]

Donaton

[11] Patent Number: 4,982,457

[45] Date of Patent: Jan. 8, 1991

[54] DEVICE FOR PREVENTING FALLING OF PERSONS BETWEEN POOL COVER AND POOL WALL

[76] Inventor: William Donaton, 1585 Sycamore Ave., Bohemia, N.Y. 11716

[21] Appl. No.: 479,443

[22] Filed: Feb. 12, 1990

Related U.S. Application Data

[63] Continuation of Ser. No. 29,231, Aug. 8, 1988, abandoned.

[51] Int. Cl.[5] ..... E04H 4/10

[52] U.S. Cl. ..... 4/504; 4/498

[58] Field of Search ..... 4/496, 498, 503, 504; 52/35, 287, 288

[56] References Cited

U.S. PATENT DOCUMENTS

| | | | |
|---|---|---|---|
| 2,227,581 | 1/1941 | Henderson | 52/287 X |
| 2,541,768 | 2/1951 | Keller | 52/287 |
| 2,870,454 | 1/1959 | Schippert et al. | 4/503 |
| 2,870,455 | 1/1959 | Reeves | 4/498 |
| 2,883,676 | 4/1959 | Kwake | 4/503 |
| 3,555,573 | 1/1971 | Turner | 4/498 X |
| 3,683,428 | 8/1972 | Morris | 4/498 |
| 4,429,425 | 2/1984 | Weir et al. | 4/503 |
| 4,601,149 | 7/1986 | Dokan | 52/287 |
| 4,706,427 | 11/1987 | Zeilinger | 52/288 |

FOREIGN PATENT DOCUMENTS

| | | | |
|---|---|---|---|
| 7830640 | 8/1979 | France | 4/498 |

*Primary Examiner*—Henry J. Recla
*Assistant Examiner*—Casey Jacyna
*Attorney, Agent, or Firm*—Alfred M. Walker

[57] ABSTRACT

A device for preventing falling of a person between a pool cover and a pool wall has a protective element including a first substantially horizontal portion arranged to be placed onto a pool cover near a pool wall, and a second portion extending from the first portion and inclined relative to the latter at an angle so as to extend toward a pool wall at an angle.

3 Claims, 2 Drawing Sheets

Fig. 1
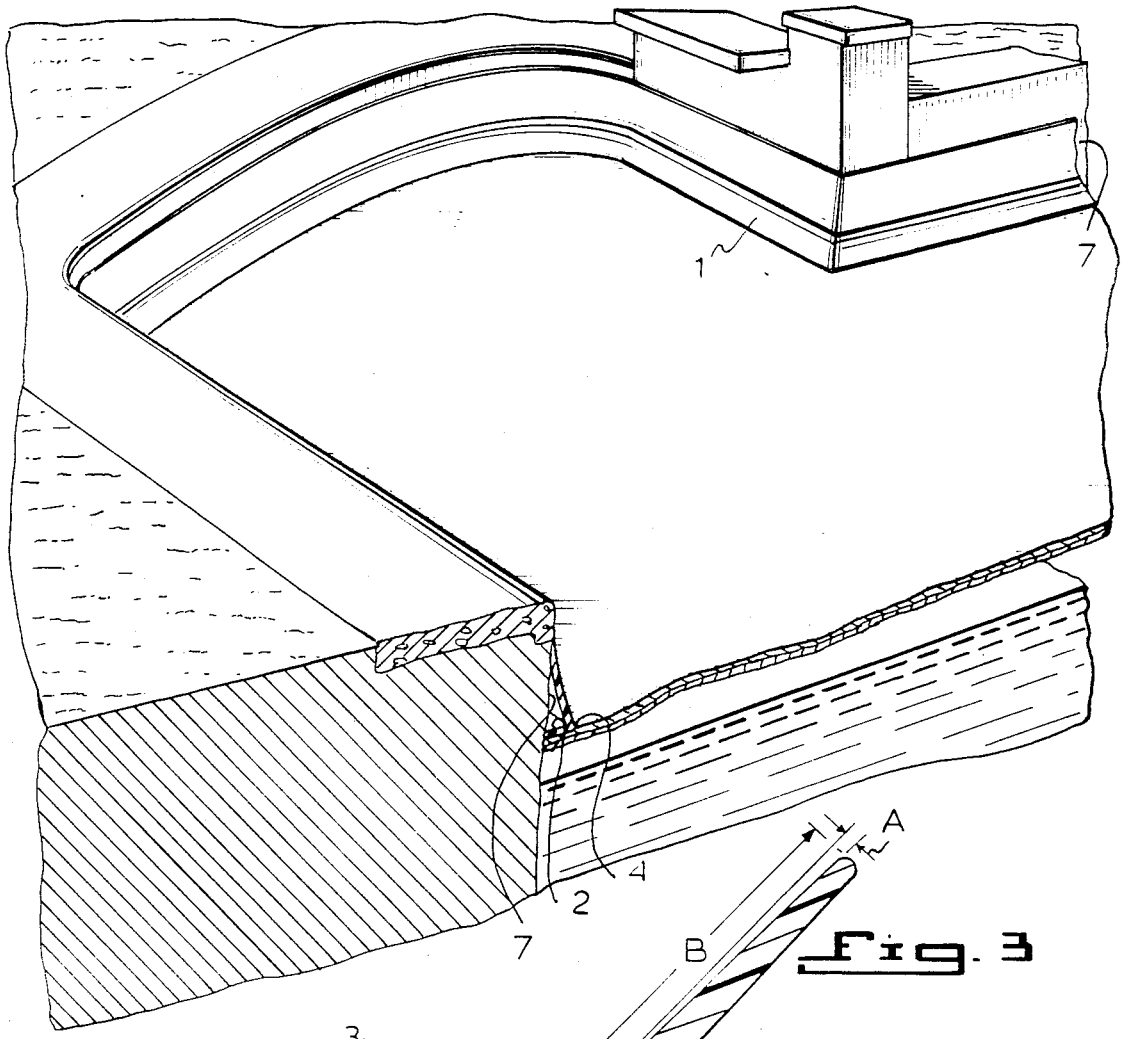
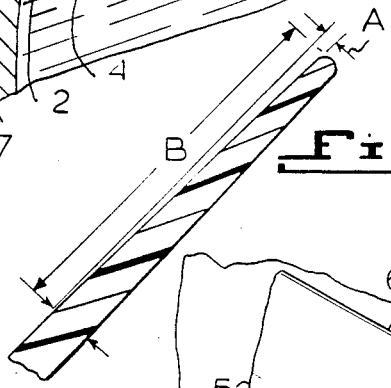
Fig. 3
Fig. 2
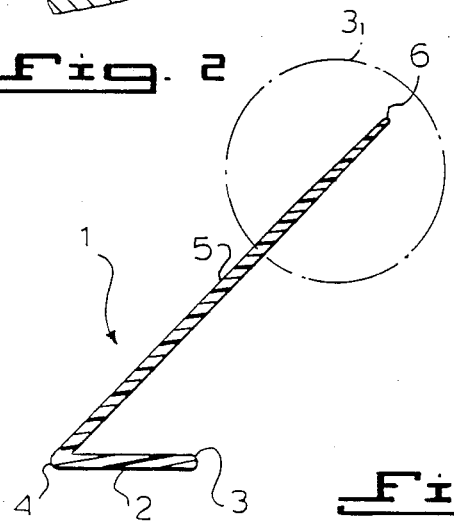
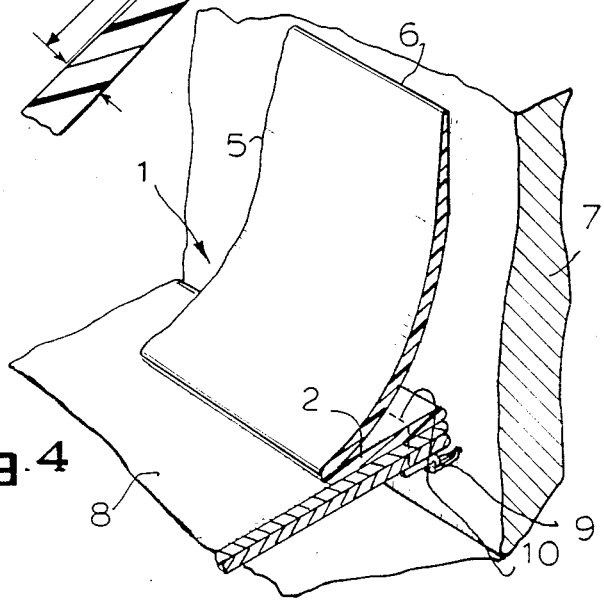
Fig. 4

DEVICE FOR PREVENTING FALLING OF PERSONS BETWEEN POOL COVER AND POOL WALL

This application is a continuation of application Ser. No. 07/229231, filed 08/08/88, now abandoned.

BACKGROUND OF THE INVENTION

The present invention relates to a device for preventing falling of people between a pool cover and a pool wall.

Pool covers are generally used for covering pools during non-swimming seasons or other periods of non-use. The pool cover can be attached to a pool wall for example by a plurality of screws or clamps which are spaced from one another by certain distances. These distances are quite dangerous areas, since people, especially children can accidentally fall onto the cover and then slip through a space between the pool cover and then slip through a space between the pool cover and the pool wall into a body of water with grave consequences. This danger is especially real in view of the fact that the material of the pool cover stretches and significant spaces are formed in the regions between the connecting screws or clamps. Some pools are also provided with rock gardens and other structures which also form free spaces between them and the cover.

SUMMARY OF THE INVENTION

Accordingly, it is an object of the present invention to provide a device which prevents falling of persons through the spaces between the pool cover and pool wall.

In keeping with these objects and with others which will become apparent hereinafter, one feature of the present invention resides, briefly stated, in a device which has a protective element with a first substantially horizontal portion arranged to be placed on the cover with an edge facing toward the pool wall, and a second portion which is inclined toward the first portion an angle relative to the latter and also extends at an angle toward the pool wall to be pressed against the latter.

As shown in FIG. 1, protective element 1 conforms to the curves surfaces of pool wall 7 by being bendable in a three dimensional spatial relationship against the curved, irregular surfaces of pool wall 7.

When the device in accordance with the present invention is installed in the pool near the pool wall, then in the event if a person stumbles into the pool his or her feet will slide over the inclined portion of the protective element and he or she will be guided not into a space between the pool cover and the pool wall, but instead toward the flat upper surface of the pool cover.

Removably adjacent to pool wall 7, protective element 1 is bendable in a three dimensional spatial relationship against the curved, irregular surfaces of pool wall 7, as shown in FIG. 1.

In accordance with another especially advantageous feature of the present invention, the outer edge of the inclined portion of the protective element extends horizontally outwardly beyond the outer edge of the horizontal portion Thereby the inclined portion is firmly pressed against the pool wall to provide for a reliable gap-free abutment against the pool wall.

Still a further advantageous feature of the present invention is that the inclined portion of the protective element has a thickness which increases from its upper edge toward its lower edge In this construction, the upper part of the inclined portion is easily flexible to adapt and follow the pool wall, while the lower thicker part of the inclined portion is strong enough to withstand weight The inclined portion is preferably flexible so as to flex for the purpose of adapting to the pool wall, and also for forming a concave curve under the action of weight This concave curve, as opposed to a straight inclined surface, reduces the speed of sliding of a person over it and toward the upper surface of the pool cover.

In another embodiment of the device, the inclined portion extends at an obtuse angle from the horizontal portion, and extends at an angle toward the pool wall to be pressed against the latter.

In a further embodiment of the device, the inclined surface is integral with the base portion in a concave curve along a cross section of the device.

The novel features of the present invention are set forth in the appended claims. The invention itself however will be best understood from the following description of a preferred embodiment which is accompanied by the following drawings.

BRIEF DESCRIPTION OF THE DRAWINGS

FIG. 1 is a view which schematically shows a pool with a pool cover and a device in accordance with the present invention;

FIG. 2 is a view which shows a cross section of the device in accordance with the present invention;

FIG. 3 is a view showing a fragment of FIG. 2, identified with reference 3; and

FIG. 4 is a perspective view of a small portion of the inventive device which is arranged in the area between the pool wall and pool cover.

DESCRIPTION OF A PREFERRED EMBODIMENT

Figure 5:
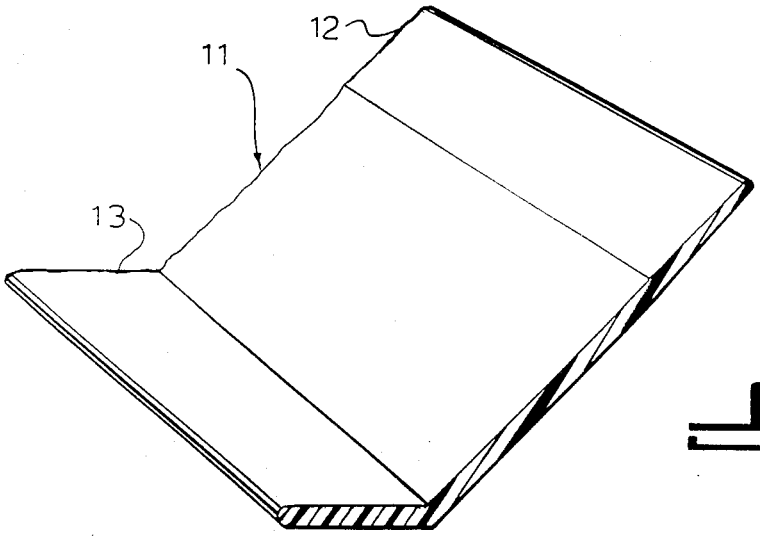
FIG. 5 is a perspective view of a small portion of another embodiment of the device.

A device for preventing falling of a person between a pool wall and a pool cover includes an elongated protective element which is identified as a whole with reference numeral 1.

The protective element 1 has a first substantially horizontal portion 2 with an outer edge 3 and an inner edge 4 as considered relative to the position of the protective element in the pool. A second inclined portion 5 extends from the inner edge 4 of the first horizontal portion at an acute angle relative to the latter, and has an upper edge 6.

Preferably, the portions 2 and 5 are formed integrally of one piece with one another The protective element as a whole can be composed of rubber or synthetic plastic, such as extruded plastic. As can be seen from FIG. 2, the inclined portion 5 of the protective element 1 has a thickness which increases in a direction from its upper 6 toward its lower and which coincides with the inner edge 4 of the horizontal portion 2

The acute angle between the portions 5 and 2 of the protective element 1 can be between 30° and 60°, preferably 45°. The length of the horizontal portion 2 as shown in FIG. 2 in cross section, can be between 1 and 2 inches, preferably 1.25 inches. The length of the inclined portion 5 can be equal to between 4 and 12 inches, preferably 6 inches.

The thickness of the inclined portion 5 can increase gradually from its upper edge to its lower edge, for example from 1/16 to ⅛ inches respectively, as indicated by dimension A in FIG. 3. The tapered portion B, as shown in FIG. 3, extends to a point after which its thickness is generally uniform. On the other hand, only the upper part of the inclined portion 5, for example over a length of 1–1.5 inches can have an increasing thickness, while the lower part has a uniform thickness. In the latter case, the thickness of the upper part increases for example from 1/16 to ⅛ inches as shown in FIG. 3.

As can be seen from FIG. 2, the upper edge 6 of the inclined portion of the protective element 1 extends significantly outwardly beyond the outer edge 3 of the horizontal portion of the protective element in a position of non-use of the device.

FIG. 4 shows the inventive device which is installed in the pool with a pool wall 7. A cover 8 is arranged inside the pool and attached to the pool wall 7 in a conventional manner, for example by screws or clamps 9. The protective element 1 is arranged in the region between the pool wall 7 and pool cover 8. Its horizontal portion is placed on the upper surface of the pool cover 8 and connected with the latter, for example by sewing seams, clamps and the like 10. The outer edge 3 of the horizontal portion abuts against the pool wall 7. The inclined portion 5 extends upwardly, is somewhat flexed so as to form a concave curve, and abuts with its upper edge 6 against the pool wall 7 with a prestress. Thereby, possible spaces or gaps between the pool wall and the pool cover are reliably closed by the protective element 1.

As can be seen from FIG. 5, in another embodiment of the device, inclined portion 11 extends at an obtuse angle from horizontal portion 13. The inclined portion 11 may taper at its end in a tapered portion 12.

Figure 6:
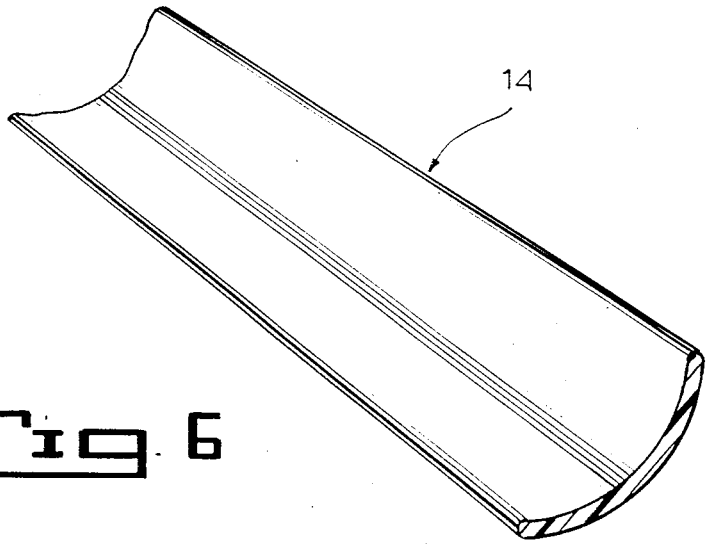
FIG. 6 is a perspective view of a small portion of a further embodiment of the device.

As shown in FIG. 6 , in a further embodiment of the device, the inclined portion 14 is integral with the base portion in a concave curve along a cross section of the device.

The invention is not limited to the details shown since various modifications and structural changes are possible without departing in any way from the spirit of the present invention.

What is desired to be protected by Letters Patent is set forth in the appended claims.

I claim:

1. A device for preventing the falling of a person between a pool cover and the surface of a pool wall wherein spatial gaps exist between said cover and said wall, and the like, comprising:

a pool cover;

a protective element formed to extend over a contour of said pool cover and a pool wall, said protective element having a cross section which includes a first substantially horizontal portion arranged to be placed onto said pool cover and having an outer edge arranged to face toward the pool interior and an inner edge arranged to face toward said pool wall;

sealing means comprising a second flexible inclined portion which extends from said outer edge of said first portion toward said pool wall at an angle relative to said first portion, said second flexible inclined portion being removably adjacent to said pool wall for cooperating with and conforming to the curved, irregular surface of said pool wall, said second portion being bendable in a three dimensional spatial relationship against the curved, irregular surface of said pool wall;

said second portion being further capable of overlapping said spatial gaps between said pool cover and said pool wall;

said second portion being inclined in its inflexed state relative to said first portion at an acute angle of substantially between 30 degrees and 60 degrees.

2. A device for preventing the falling of a person between a pool cover and the surface of a pool wall wherein spatial gaps exist between said cover and said wall, and the like, comprising:

a pool cover;

a flexible protective sealing means extending over a contour of said pool cover and said pool wall, said sealing means having a cross section forming an inclined concaved curved portion in its inflexed state, such that the bottom of said portion is arranged to be placed onto said pool cover, and the outer edge, facing the pool wall, of said curved portion extends upwardly and outwardly toward said pool wall;

said sealing means being bendable in a three dimensional spatial relationship against said curved, irregular pool wall;

said sealing means being further capable of overlapping said spatial gaps between said pool cover and said pool wall;

said sealing means being removably adjacent to said pool wall.

3. A device for preventing the falling of a person between a pool cover and the surface of a pool wall wherein spatial gaps exist between said cover and said wall, and the like, comprising:

a pool cover;

a protective element formed to extend over a contour of said pool cover and said pool wall, said protective element having a cross section which includes a first substantially horizontal portion arranged to be placed onto said pool cover and having an outer edge arranged to face toward the pool interior and an inner edge arranged to face toward said pool wall;

sealing means comprising a second flexible inclined portion which extends from said inner edge to said first portion toward said pool wall at an angle relative to said first portion for cooperating with and conforming to said surface of said pool wall;

said second flexible inclined portion being bendable in a three dimensional spatial relationship against the curved, irregular surface of said pool wall, said second portion being further capable of overlapping said spatial gaps between said pool cover and said pool. wall;

said second portion being removably adjacent o said pool wall;

said second portion having upper and lower edges and a thickness which increases in a direction from said upper edge towards said lower edge and said upper edge being located horizontally outwardly beyond the outer edge of said first portion as considered in a direction from said inner edge toward said outer edge of said first portion;

said second portion being inclined in its inflexed state to said first portion at an obtuse angle of substantially between 120 degrees and 150 degrees.

* * * * *